US005368440A

United States Patent [19]

Japikse et al.

[11] Patent Number: 5,368,440

[45] Date of Patent: Nov. 29, 1994

[54] RADIAL TURBO MACHINE

[75] Inventors: David Japikse, Norwich; David M. Karon, South Royalton, both of Vt.

[73] Assignee: Concepts ETI, Inc., Norwich, Vt.

[21] Appl. No.: 31,162

[22] Filed: Mar. 11, 1993

[51] Int. Cl.[5] ..... F04D 29/44

[52] U.S. Cl. ..... 415/208.3; 415/211.2

[58] Field of Search ..... 415/181, 191, 208.1, 415/208.2, 208.3, 211.1, 211.2, 914; 416/223 R, 223 A, 223 B, DIG. 2, DIG. 5

[56] References Cited

U.S. PATENT DOCUMENTS 3,904,312 9/1975 Exley ..... 415/181
4,519,746 5/1985 Wainauski et al. ..... 416/233 R
5,011,371 4/1991 Gottemoller ..... 415/208.3

FOREIGN PATENT DOCUMENTS 0000399 1/1989 Japan ..... 415/211.1

OTHER PUBLICATIONS

J. C. Emery et al., NACA Report 1368, "Systematic Two-Dimensional Cascade Tests of NACA 65-Series Compressor Blades At Low Speeds", 1958, pp. 1-85.

*Primary Examiner*—Edward K. Look
*Assistant Examiner*—Christopher Verdier
*Attorney, Agent, or Firm*—Richard J. Birch

[57] ABSTRACT

A radial turbo machine has an impeller and a diffuser with a plurality of airfoil vanes. The airfoil vanes have a design point angle of attack substantially equal to or less than the angle of attack corresponding to the classic onset of pressure side stall of the airfoil vane. The pressure side of the airfoil vane faces away from the rotational axis of the impeller while the suction side faces towards the impeller's rotational axis.

18 Claims, 9 Drawing Sheets

RADIAL TURBO MACHINE

BACKGROUND OF THE INVENTION

The present invention relates to radial turbo machines in general and, more particularly, to radial turbo machines having airfoil vanes with a design point angle of attack substantially equal to or less than the angle of attack corresponding to the classic onset of pressure side stall.

The technology which has historically been applied to the airfoil or cascade diffuser design for centrifugal compressors comes in fact from the air compressor field. Technology for the axial compressor blading was developed by various groups around the world but the most prominent set of investigations was reported by National Advisory Committee for Aeronautics ("NACA"—See NACA Research Memorandum L582A02, declassified Dec. 1, 1959). The so-called NACA airfoil data includes a variety of representations with two important ones as shown in FIGS. 1 and 2 for the momentum loss coefficient and the low turning angle respectively. The important parameter on the abscissa of FIGS. 1 and 2 is the angle of attack. Angle of attack is frequently denoted in the open literature as "alpha". However, "AOA" is used herein to denote angle of attack because alpha can be used for other parameters as well.

The definition of angle of attack is shown in FIG. 3. The angle of attack "AOA" is the difference between an inlet flow angle and the airfoil or vane setting angle, gamma. The gamma angle is called the stagger angle and is established by a line passing through the trailing edge point and the leading edge point on the airfoil. By comparison, FIG. 3*b* shows the definition of incidence as widely used in turbomachinery. Incident and angle of attack are generally not the same. The incidence is formed by the relative flow direction (the mine line as used for relative flow direction in the AOA definition) compared with the regent to the mean camber line. Through the center of the airfoil is the mean camber line and the tangent to this at the leading edge forms a reference line which helps define incidence. Clearly, incidence and angle of attack will be the same only when there is no camber in the airfoil. In other words if one uses a zero camber or a flat plate type vane, then the incidence and angle of attack will be the same.

The information shown in FIGS. 1 and 2 was developed for the axial compressor turbomachinery application. The data was all taken from long vanes in a linear cascade test configuration. The data was taken by using approximately five or seven vanes, of substantial height, compared with the four for axial length. In this case, the end walls (at the top and bottom of airfoil) were far removed from the mean section. The experimental data shown in FIGS. 1 and 2 were taken at the mean section and hence had little influence of the end wall flow process. This was the intention of the original investigators as it most nearly represented significant and substantial portions of the axial compressor flow field. Of course, the end wall regions were important, even for the axial compressor at the time when these investigations were carried out, but the intent was to look at the core flow which is more ideal in nature and not confused by the end wall flows. This core flow is nearly an ideal flow and the streamlines more or less followed the intent of the blading curvature so that the flow angles through the cascade nearly follow the path set by the curvature of the blade. This flow is usually described as a potential flow which follows the Euler or Poisson equation of fluid mechanics and it is not strongly influenced by appreciable viscous effects. The viscous effects are restricted to a thin shear layer near the surface of the vane itself giving a boundary layer buildup of some momentum deficit yielding some losses and these are known as the "profile losses". In addition, the mixing of the boundary layers on the suction and pressure side give a trailing edge effect proportional to the thickness of the trailing edge and so the losses represented in FIG. 1 are the sum of the wall shear layers (that is, the boundary layers) and the exit mixing of the wake from the (non-zero) trailing edge thickness. This is the classical profile and trailing edge loss portion of the flow field and was the specific intent of the original NACA investigation.

FIG. 1 displays the momentum loss coefficient which is directly proportional to the total pressure loss for the blade under the conditions of this potential flow and thin wall shear flow process. The amount of turning which can be achieved with this airfoil is shown in FIG. 2 depending upon the angle of attack of the flow approaching the surface of the vane. When operation is attempted at very high levels of angle of attack, the flow separates from the suction side and the airfoil is no longer a useful element in the flow process. All turbomachines operate over a variety of levels of the angle of attack. However, there is a design point which is usually chosen near the minimum loss of the airfoil blade row. FIG. 1 illustrates this minimum loss band.

For lower Mach number operation, including the data sets of 0.0, 0.3, 0.5, and 0.7 Mach number of FIG. 1, the acceptable range of design and principal operation is approximately 3.5° to 9.5° which centers around the 6.5° arrow shown in FIGS. 1 and 2 by the original NACA investigators. Rational design practice calls for a design point in this range and principal operation of the cascade within this particular range. At higher and lower levels of angle of attack, the losses rise very rapidly as stall develops. Stall at high angles of attack is on the vane suction side; stall at the low angle of attack occurs on the vane pressure side. It should be noted that high angle of attack corresponds to low flow rate whereas low angle of attack correspond to high flow rates in the blade row.

The stall levels were taken by the original investigators to be the condition where noticeable stall could be detected. Means of stall detection have varied substantially over the years and an absolute designation of precise stall criteria is usually lacking from the historical data base of cascades and full three-dimensional turbomachinery blade rows. However, it is clear from FIG. 1 that the losses have risen very rapidly and by cross-examination between FIG. 1 and FIG. 2, at the high levels of angle of attack, clearly the airfoil is beginning to lose its turning capability. For a single airfoil used as an airplane wing, this would correspond to the deterioration of lift and the condition where the plane would stall and rapidly lose altitude. The exact level is not terribly important; the important fact is that losses have risen very rapidly as stall is developing and has a very high slope at the point where the investigator felt that stall had appreciably occurred.

It is common to say that the rapid rise in losses approaching the stall point can be considered incipient stall or regions of developing stall. For example, consider the left hand side of FIG. 1 dealing with levels of angle of attack from approximately 0° to 3.5° . As discussed above, operation from 3.5° to 9.5° would be common and rational. A designer would never intentionally desire any appreciable margin of operation in the region of approximately 0.5° to 3.5°, the lower region tested by the NACA investigators. This is a region of some instability and a region of very high losses. This region would not be selected for normal operation nor ever selected for a design point operation following classical theory.

Turning next to the consideration of different airfoils in the NACA series, FIGS. 4a–4d depict four different airfoils. (See NACA Report #1368, 1958) FIG. 4a is 65-010 airfoil. This is the infamous NACA 65 series with a 0 camber and 10% thickness. FIG. 4b is the 65-410, followed by 65-810 of FIG. 4c and than a 65-(12)10 cascade in FIG. 4d. This set of four airfoils is selected because it goes from 0 to 1.2 lift coefficients with a set of consistent data. Different cascade stagger angles (which was varied to change the inlet gas angle) and different thickness will give different sets of measured results. For the data in FIG. 4a, it can be seen that the pressure side stall is not even shown on the first diagram; the rise begins at approximately 0° for the second case; the rise begins at approximately 3.5° for the third case and corresponds to approximately 6° for the fourth case. For the very first case, the pressure side rise might be at approximately 2° to −4°. Note that FIG. 4b is almost the same airfoil specification as the data of FIGS. 1 and 2, but corresponds to testing at low Mach number, a different stagger angle giving the inlet flow angle of $\beta_1=70°$ at the reference point (versus 50.5° for FIGS. 1 and 2), and 10% thickness versus 6% of FIGS. 1 and 2.

The important part of FIGS. 4a–4d is the lower lines which are the equilateral triangles, which is the momentum loss coefficient. The other lines are not significant for the purpose of this present discussion.

A further illustration of the pressure side stall variation can be seen in FIGS. 5a and 5b from G. L. Mellor, M. I. T., "Gas Turbine Lab", 1956 and Mellor, G. L., "The 65-Series Cascade Data", from Horlock, J. H., "Axial Flow Compressors", Butterworths, London, 1958, pp. 64–69. These are known in the industry as the "Mellor plots". Mellor has plotted up the turning information for a wide variety of NACA tests in the format shown in FIG. 2. The inlet flow angle is $\alpha_1$ and the outlet flow angle is $\alpha_2$ in any given diagram. The central plots illustrate the scheme of these sketches. The data runs between the two stall limits. In the bottom, Mellor's definition of stall corresponds to a drag coefficient 1.5×'s the nominal or mid-point drag coefficient. It is a point where considerable stall has occurred, although there is no rigorous definition as to where extensive stall would lie. The stall line on the upper side of the cross-hatched diagrams is the pressure side stall.

The fundamental foundation of the NACA data and its applicability to radial turbomachinery will now be discussed. As indicated before, all of this data was taken for high aspect ratio blades, meaning that the height was approximately five times greater than the chord, or more. The assumption made by radial turbomachinery designers is that the NACA cascade geometry and performance data, or any other standardized system of airfoil definition and corresponding dam, should be transferable if not in its totality at least in substantial part from the axial compressor to the centrifugal compressor application. In so doing, it is expected that the design point angle of attack, approximately 6.5° in FIG. 1 as discussed above, would be the intended design point. In making this presumption, designers have presumed that the potential flow character as described by an Euler equation or a Poisson equation, has basic validity and applicability for the centrifugal compressor case, as it did for the axial compressor case. The flow is assumed to be basically potential in character with principal viscous effects in the thin shear layer on the surface of the vane. This assumption may well be valid in some cases for centrifugal compressors.

For centrifugal compressors with very high vane height, compared with other meaningful dimensions, it is quite possible that a portion of the flow field, perhaps even a substantial portion, will have a potential flow character and principal viscous effects will be located near the surfaces of the diffuser vane. This is probably the case for many of the investigations carried out by Professor Senoo during the late 70s and early 80s. His work was carried out with large scale blowers with very substantial diffuser width. In his cases, he initially studied vaneless diffusers and then subsequently some high performance LSA diffusers. For the blowers, he showed that the side wall effect was very small compared with what was happening in the core of the flow. In other words, as the flow left the impeller and entered the diffuser, the wall shear effects amounted to a few percent of the passage width (i.e. distance from the front and from the back side, that is from the shroud and from the hub sides). In this case, the classical airfoil theory would be expected to be quite applicable. However, the great majority of industrial applications of centrifugal compressors, blowers and pumps deal with situations where the impeller exit width is much smaller.

There is no absolute or universally accepted measure of what this width is, but one scale that is frequently used is the $b_2r_2$ parameter which can vary from low values to maybe 0.01 to 0.02 on the low side up to high values of approximately 0.2; $b_2$ is the impeller exit width which is normally the diffuser inlet width as well; $r_2$ is the radius of the rotor (exit) that is, the compressor, blower or pump impeller. Impeller and rotor are interchangeable words for all practical purposes. The investigations by Senoo correspond to very high values of $b_2/r_2$; this is a fringe of the industrial radial flow turbomachinery world.

The vast majority of the industrial radial turbomachinery world deals with lower values of $b_2/r_2$. In this case, the end wall boundary layers are no longer small or insignificant in any way and in fact they frequently merge so that the entire flow field is dominated by viscous shear effects from the side wall. In this case, one would seriously question how pertinent or relevant FIGS. 1 and 2 would be to the design process of a centrifugal compressor, blower or pump. The original NACA investigations correspond to high aspect ratios of typically 5 or more. A typical range of the aspect ratio parameter for industrial work is 0.1 to 0.4; this is approximately the inverse of the values used for the original NACA investigation. Even though there are significant differences in this aspect ratio, and consequently significant effects concerning the end wall boundary layers merging together so that the viscous effects dominate the entire flow field, there is still a legitimate reason to think that the NACA idealized flow field may still be a very useful guideline for designs under these radically different conditions.

The reason is the following. The full three-dimensional viscous flow field which is known to exit the centrifugal rotor, has a very complex structure of forces which yields a very three-dimensional and unsteady flow field. However, buried in the heart of all these forces is still the basic potential flow equation as the root set of equations. In modern flow analysis, the basic inviscid problems can still be seen as the fundamental set of equations and the fundamental character of the flow and all of the other forces that are present modify this to a greater or lesser degree. It is with this general perception that designers for a long time, either by intent or out of ignorance, have persisted in using the potential flow theory corresponding to the NACA cascade and corresponding data in designing diffusers for centrifugal compressors, pumps and blowers.

All design processes known at the present time for the cascade diffuser of radial turbomachinery stages have been based on the assumption that the flow is inherently of the character established in the NACA data set and that this information can be transformed from the axial to the radial turbomachine stage. In other words, the information from the axial compressor investigation, with high aspect ratios, could be transferred to the centrifugal compressor stages even if the aspect ratios are low. All known studies have suggested that this was essentially the case and was a safe design process. The techniques were well summarized by Pampreen in a text where he described tandem airfoil diffuser design under NACA cascade procedures. It has always been presumed that one can use mathematical conformal transformation to take the shape from the axial compressor and use it in the radial turbomachine and the momentum loss and turning data of FIGS. 1 and 2 would be applicable directly for the radial stage.

To understand the design process, reference is made to FIG. 6. FIG. 6 displays a typical compressor map. In modern design, one attempts to obtain wide map width, with broad operation from the choke line to the surge line. This range is made as great as possible, for most industrial applications, and that the islands of efficiency are as broad as possible and as high as possible. In addition, smooth, stable and quiet operating characteristics are desired in modern applications. To do this, a designer typically selects one or more design points typified by DP1 on FIG. 6. When more design points are employed, they are given a secondary position and evaluated subsequent to the effort at DP1 or in a nearly parallel way with principal emphasis still on DP1. The design point that is DP1, is usually located on the intended operating speed characteristic, which is usually designated as 100% speed or design speed, and at a point somewhere between the choke characteristic and the surge characteristic.

For pumps, a simpler approach is used and the design point is usually at the point where best efficiency is desired. For compressors and blowers, the design point is not necessarily located at the point where best efficiency is intended or desired. If the design point is intended to be at or near the best efficiency point, then it is desired to line up all of the flow angles within the machine so that they are near optimum. This means that the flow should approach each bladed element in a nearly optimum flow. By referring back to FIG. 1, it can be seen how the design point arrow for the design angle of attack of 6.5° is intended to be used. One can consider an overlay of FIG. 1 and FIG. 6. At the design point, the angle of attack for the cascade would be controlled or set at a level of 6.5° by setting the stagger angle (see FIG. 3) appropriately. As one operates to higher flows or lower flows, lower or higher (respectively) levels of angle of attack are encountered. Therefore, one operates to the right or left of the 6.5° angle of attack level, which is the design angle of attack on FIG. 1. It is desirable to stay mostly in the bottom of the bucket shown in FIG. 1, that is between angle of 3.5° and 9.5°. For axial compressors this is usually achieved, with maybe some slight excursions up the side walls of this loss bucket. For centrifugal compressors, operation is generally wider and more excursion up the side may be obtained.

For either axial compressors or centrifugal compressors, historical design practice has mandated that the operation is essentially along the bottom of the loss bucket (3.5° to 9.5°) with little or no operation up the side walls. Any operation up the side walls would be roughly balanced so that it would remain centered around the 6.5° angle of attack for this chosen airfoil series. If, however, a modern compressor designer wanted to achieve some unusual effects, it might be desired to slightly mismatch that DP1, so that instead of failing on the peak efficiency contour, it might be moved somewhat to the right or somewhat to the left to achieve some other condition in terms of stability, vibration control or to widen the map in terms of broader efficiency contours even though loosing some peak efficiency. Sometimes, by coupling effects of impeller, diffuser, volute, or other elements such as return vanes or inlet guide vanes, it is possible to broaden the map by intentionally mismatching elements. Therefore, under some design practices one might depart somewhat from 6.5° angle of attack shown in FIG. 1. When this is done, it is only a move of a couple of degrees from the intended 6.5 for preferred design angle of attack. Typically a departure of 1°, 2°, or maybe 3° would be the maximum ever considered. This approach outlines the classical approach to the use of a NACA cascade and corresponding loss bucket and turning angle diagram (FIG. 1 and 2, respectively) for both axial and radial turbomachinery designs.

SUMMARY OF THE INVENTION

A radial turbo machine has an impeller and a diffuser with a plurality of airfoil vanes. The air foil vanes each have a pressure side facing away from the rotational axis of the impeller and a suction side that faces towards the impeller's rotational axis. At least some or all of the airfoil vanes have a design point angle of attack substantially equal to or less than the angle of attack corresponding to the classic onset of pressure side stall of the airfoil vanes. For a NACA 64-04-06 airfoil shape, optimum performance is achieved at an AOA of approximately 0° with good performance from −2° to +2° and usable performance at −3.5° to +3.5°.

At least some/or all of the airfoil vanes can be cambered. Alternatively, at least some or all of the airfoil vanes can be uncambered. For NACA 65 series blade section with a lift coefficient of from 0.0 to 1.2 inclusive, the thickness ranges from 4% to 15% inclusive.

BRIEF DESCRIPTION OF THE DRAWINGS

The objects and features of the invention will best be understood from a detailed description of a preferred embodiment selected for purposes of illustration, and shown in the accompanying drawings, in which.

DETAILED DESCRIPTION OF THE INVENTION

Figure 7:
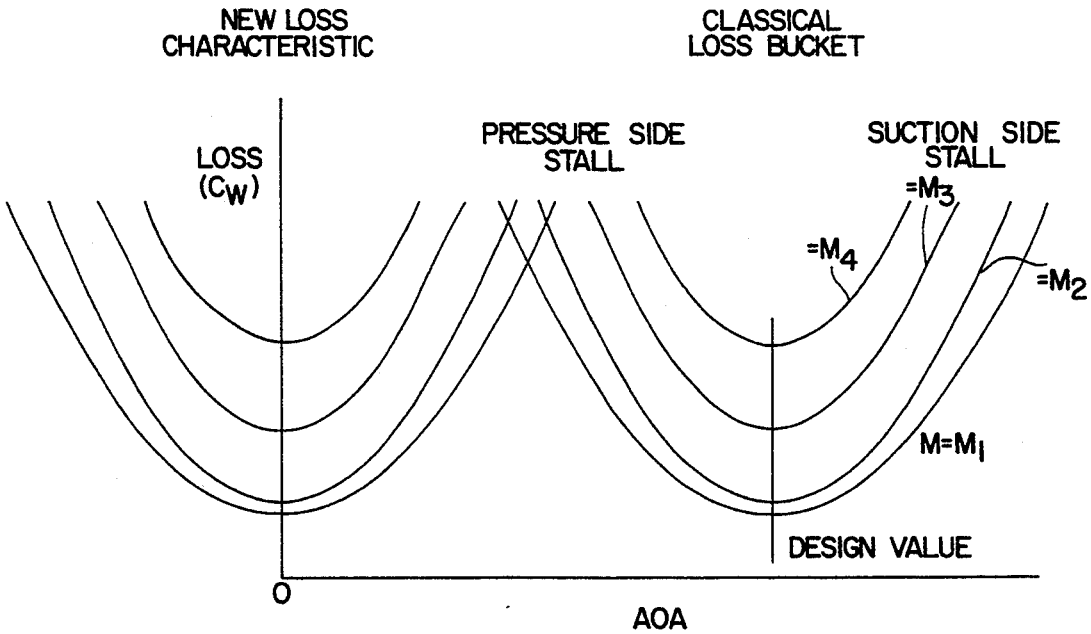
FIG. 7 is a diagram illustrating the leftward shift in the loss buckets in the present invention with the loss buckets substantially centered on 0° angle of attack ("AOA")

The invention utilizes a design point angle of attack (AOA) of significantly different magnitude than the classic design technique. Using a compressor stage in common industrial production, the entire character of this historical picture has been changed. A preferred design angle of attack of 0° was obtained with the loss buckets shifted approximately as shown in FIG. 7. The fundamental character of any bladed row is to develop a loss bucket essentially of a form shown in FIG. 1 and this character can be found in all common text books on turbomachinery performance. FIG. 7 shows these buckets shifted to the left so that they now center on 0° angle of attack. The shifted loss buckets are illustrative of the basic character of the new performance. Investigation shows that the design angle of attack of 6.5° was significantly inferior to 0°. Optimum performance was found at approximately 0° with good performance still at +2° and −2° and usable performance at +3.5° and −3.5° for a NACA 65-04-06 airfoil shape.

Figure 1:
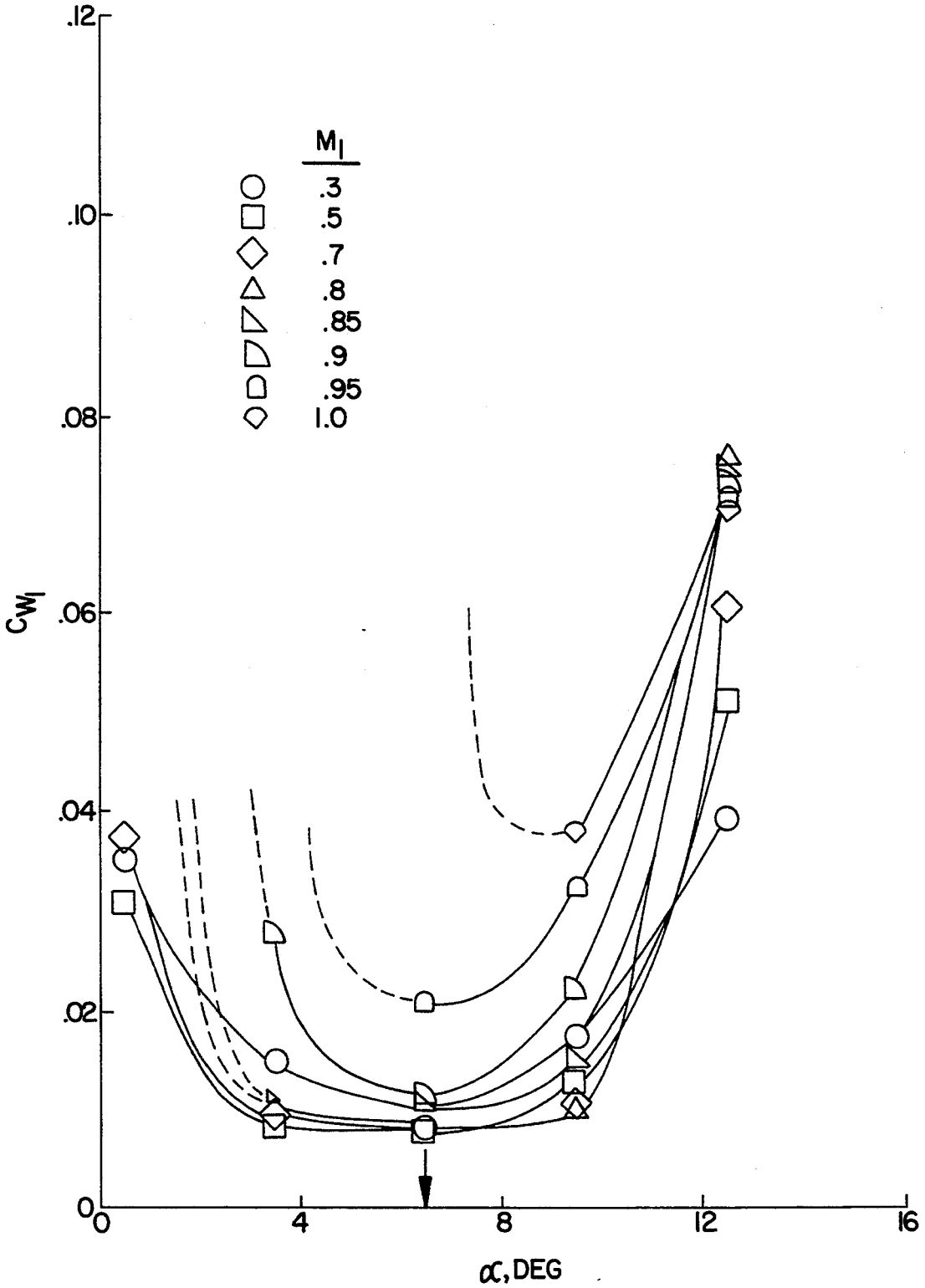
FIG. 1 PRIOR ART
FIG. 1 is a prior art diagram illustrating the variation of momentum loss coefficient with angle of attack for a cascade combination $\beta_1-\alpha=50.5°$ $\sigma=1.0$ and a NACA 65-04-06 blade section.

The fundamental point is that the design angle of attack now fails well to the left of the pressure side stall condition. According to classical theory, this should never be done in a design as it would have very bad performance and would never be accepted by an experienced designer. This present approach shows that the best angle of attack for design is approximately 0° and therefore the buckets would center about that angle for the specific NACA 65-04-06 airfoil blade section. It is equally clear that a value of AOA=1° or 2° is just as revolutionary as the design AOA of 0°. These values still fall in the area that is clearly incipient stall when viewed from the axial compressor technology point of view. This incipient stall region is characterized by instability, occasionally some noise, high losses and generally a region that a designer does not want to have any appreciable operation. In fact, anything below approximately 3.5° on FIG. 1 is a region that classically would not be considered for design point usage or regions near the design point.

Figure 2:
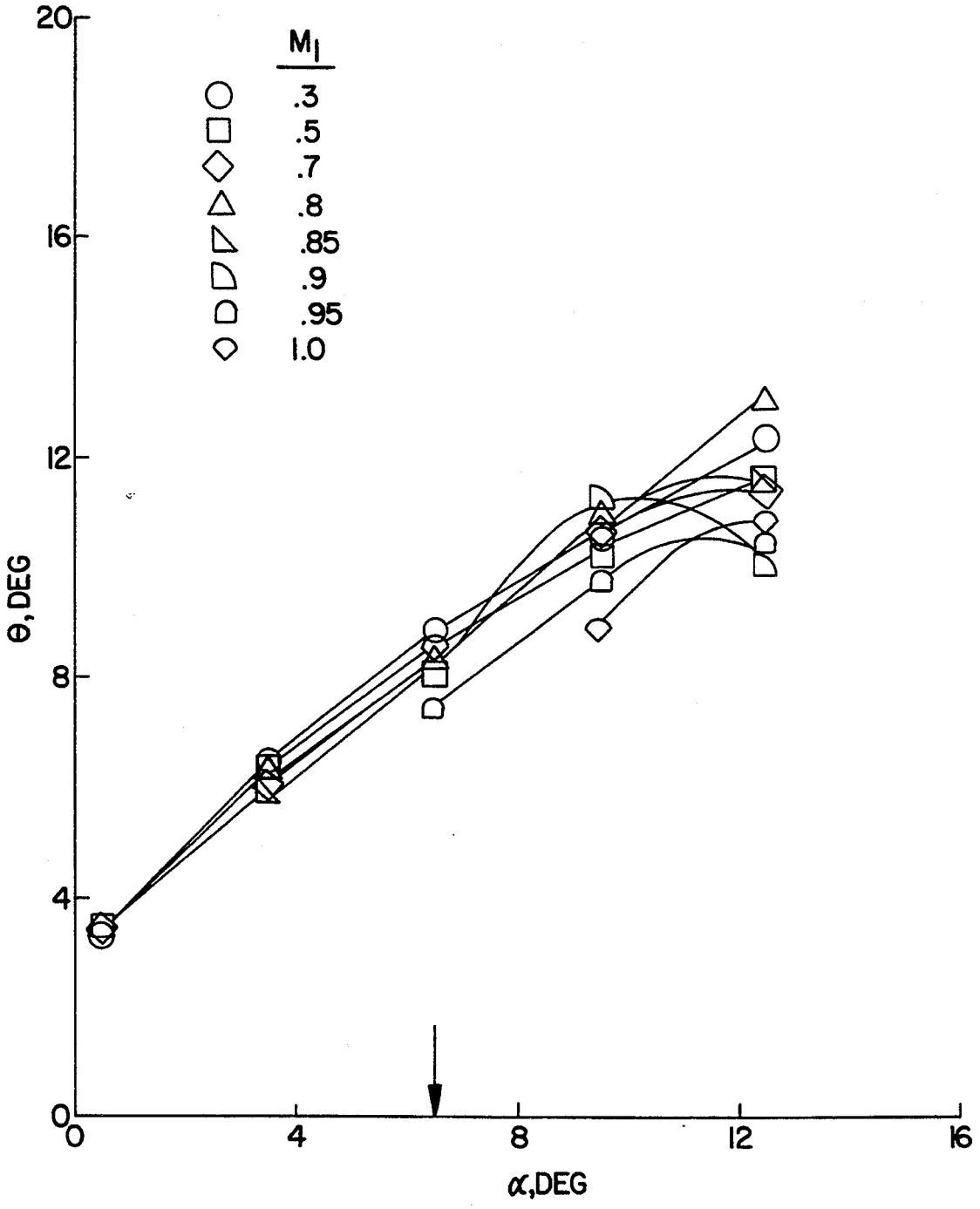
FIG. 2 PRIOR ART
FIG. 2 is a prior art diagram illustrating the variation of turning angle with angle of attack at constant Mach number for a cascade combination $\beta_1-\alpha=50.5°$ $\sigma=1.0$ and a NACA 65-04-06 blade section.

It is interesting to consider the flow processes which cause this improvement. As described previously, the aspect ratio is a key difference between the axial and radial applications, one being essentially the inverse of the other. Due to the very low aspect ratios for radial turbomachinery, at least for all levels of $b_2/r_2$ except the highest extreme, the end wall boundary layers are very significant and secondary flows dominate the performance of the diffuser element. Consequently, the inherent potential flow character of the original NACA investigation, as reflected in FIGS. 1 and 2, might be expected to only loosely apply for the radial turbomachinery application. Departures from the idea or potential flow character consequently would be rational. As a consequence, the airfoil is no longer simply a lifting surface as experienced in axial compressor application or wing theory, but is also a flow guide for the complex secondary flows leaving the impeller. It is the combination of guiding the diverse and disorganized stream tubes leaving the rotor plus the lifting effect of the airfoil shape which results in the good performance achieved and which results in a design requirement of a substantially different angle of attack. It should also be noted that the performance improved substantially when the design angle of attack was changed from the recommended level of approximately 6.5° down to the new level of essentially 0°.

It should be understood that the flow leaving a radial turbomachine passage is usually very complex. In axial machinery, particularly the mid-span, the flow is moving on a cylindrical surface whose center line is the axis of the machine. It is almost a planer type of flow although the plane is actually wrapped on a bit of the cylinder. The flows move in and out of each blade row essentially on this simple sheet which is nearly planer. For a centrifugal compressor, pump or blower, the flow in fact enters in a nearly axial direction and leaves the impeller in a nearly radial sense but with a tremendous amount of swirl, that is tangential velocity superimposed on to this axial to radial flow path. As the flow passes through the centrifugal rotor, the effects of curvature and rotation are very strong and cream very complicated flow fields. Some stream tubes pass through the rotor in a nearly ideal form and are essentially loss free that is, isentropic, or even potential in nature. By contrast, however, any of the stream tubes have lower momentum due to the lower relative velocities entering near the hub and also due to the shear stresses on the surfaces of the blades, and therefore, are swept in unusual directions. A substantial secondary flow is developed in the passage which has a flow character roughly like the wake off a boat or like the vorticity in a tornado which passes across the prairies and into the midwest. These wavelike flows and tornado type flows are commonly found and observed in radial machinery blade passages. Consequently, the flow leaving a radial turbomachinery stage has many different vector components. Some of the streamline flow vectors are in the directions which would be expected from ideal or potential flow theories; many of the streamlines are not. Many of the streamlines depart substantially from the intended or ideal direction and can never be forced to line up with the leading edge of a subsequent vane (diffuser). Inasmuch as each blade passage contains its own set of three dimensional (and unsteady) flow vectors, the resultant flow field which leaves the rotor and enters a diffuser passage, or a diffuser leading edge, is continuously fluctuating as each rotor blade passage passes the diffuser vane leading edge. Thus each diffuser vane leading edge sees a continuous fluctuation in flow angle and velocity intensity. In addition, the turbulence components are varying continuously as well from very low values of a few percent to high values in excess of 20 or 30%.

The vorticity in the rotor, such as the elements to the flow which resemble tornadoes on the earth's surface, certainly represent regions of very strong velocity and angle variations and very strong turbulence fluctuations. They follow separate conservation laws and attempt to conserve vorticity rather than to follow the common laws of momentum conservation as taught by Newton. As a result, the flow field leaving the rotor is exceedingly complex and the diffuser must accept this complicated flow field. The original work carried out by NACA and embodied in the data shown as FIGS. 1 and 2 addresses only the simplest part of the flow field which leaves a centrifugal compressor rotor. Certainly, the basic ideal character is an aspect of the flow, but the secondary flows are dominant for many geometric configurations. Thus the present invention's configuration of the diffuser vanes is better suited to the complex flow field leaving most compressor, pump and blower rotors. In other words, the classical application of cascade theory, by using conformal transformations or any other methods of laying out cambered airfoils in a centrifugal compressor, pump or blower stage must be modified substantially so as to use a completely different angle of attack. Values on the order of 0° are preferred over values on the order of 6.5°.

Figure 3B:
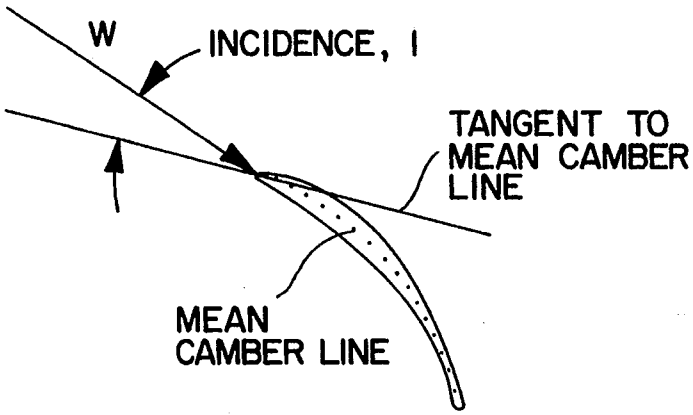
FIG. 3b PRIOR ART
FIG. 3*b* is a prior an diagram defining incidence ("I")
Figure 3A:
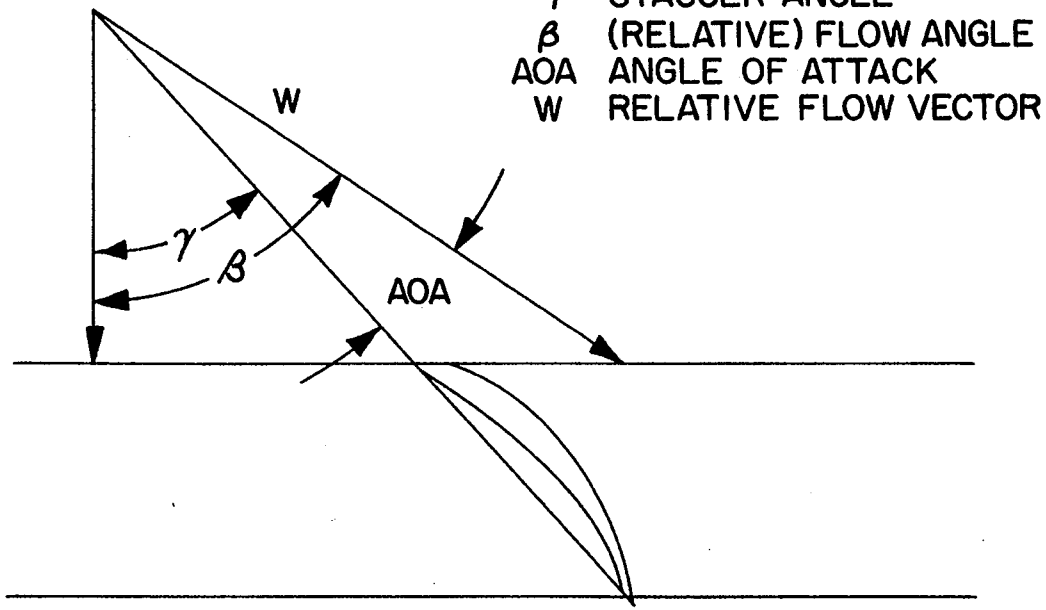
FIG. 3a PRIOR ART
FIG. 3 is a prior an diagram defining angle of attack ("AOA")
Figure 4A:
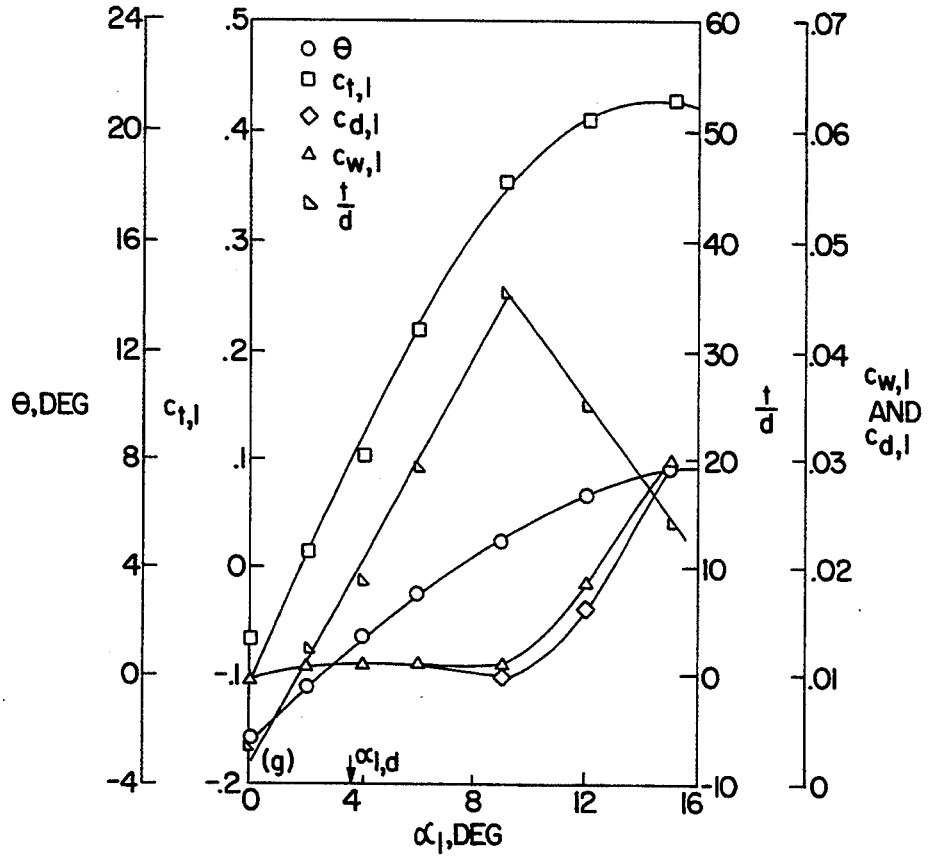
FIG. 4a PRIOR ART
FIG. 4*a* is a prior an diagram illustrating the blade section characteristics for the cascade combination $\beta_1=70°$, $\sigma=1.00$ and blade section NACA 65-010.
Figure 4B:
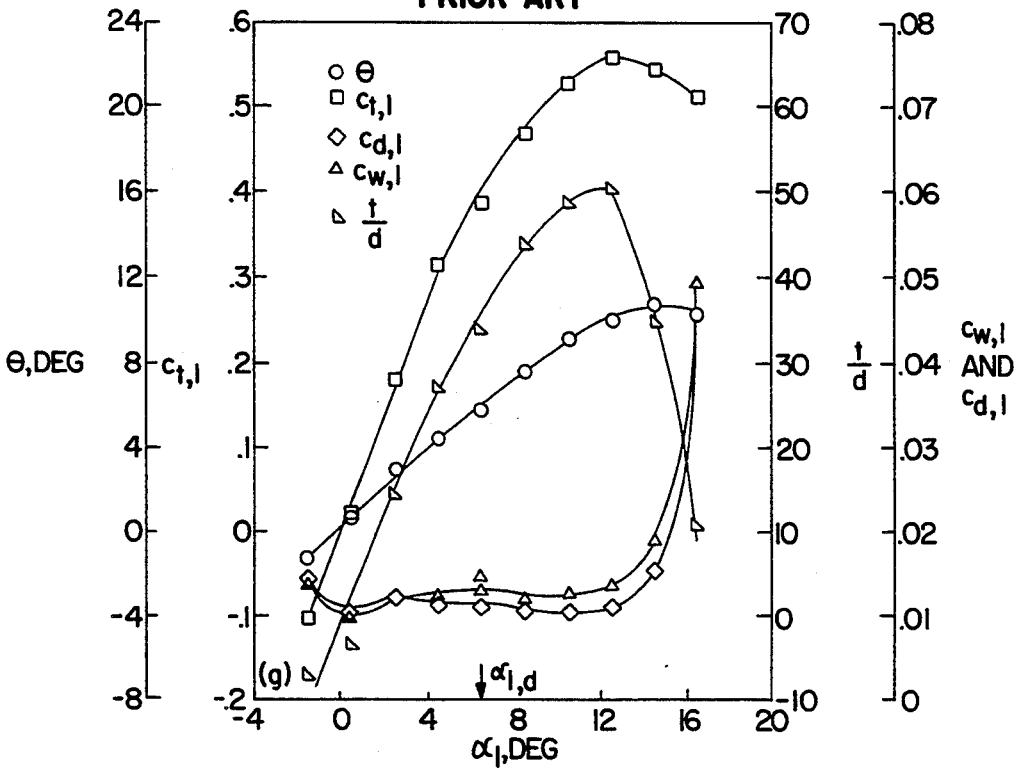
FIG. 4b PRIOR ART
FIG. 4*b* is a prior an diagram illustrating the blade section characteristics for the cascade combination fit $\beta_1=70°$, $\sigma=1.00$ and blade section NACA 65-110.
Figure 4C:
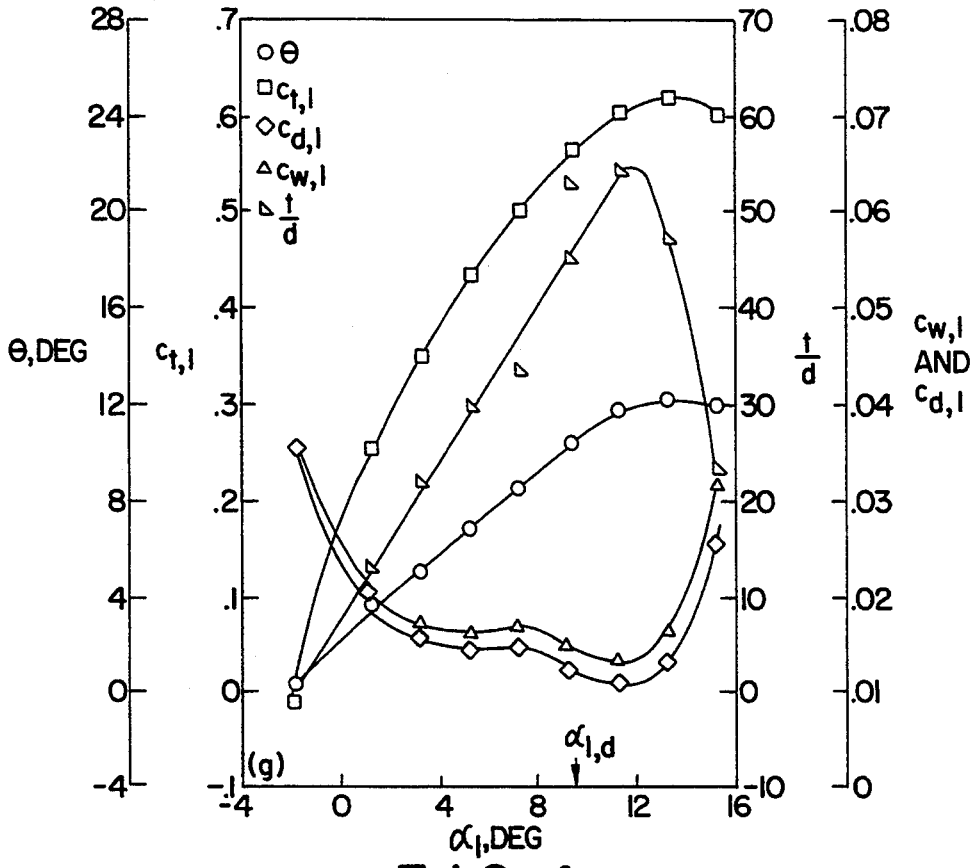
FIG. 4c PRIOR ART
FIG. 4*c* is a prior an diagram illustrating the blade section characteristics for the cascade combination $\beta_1=70°$, $\sigma=1.00$ and blade section NACA 65-810.
Figure 4D:
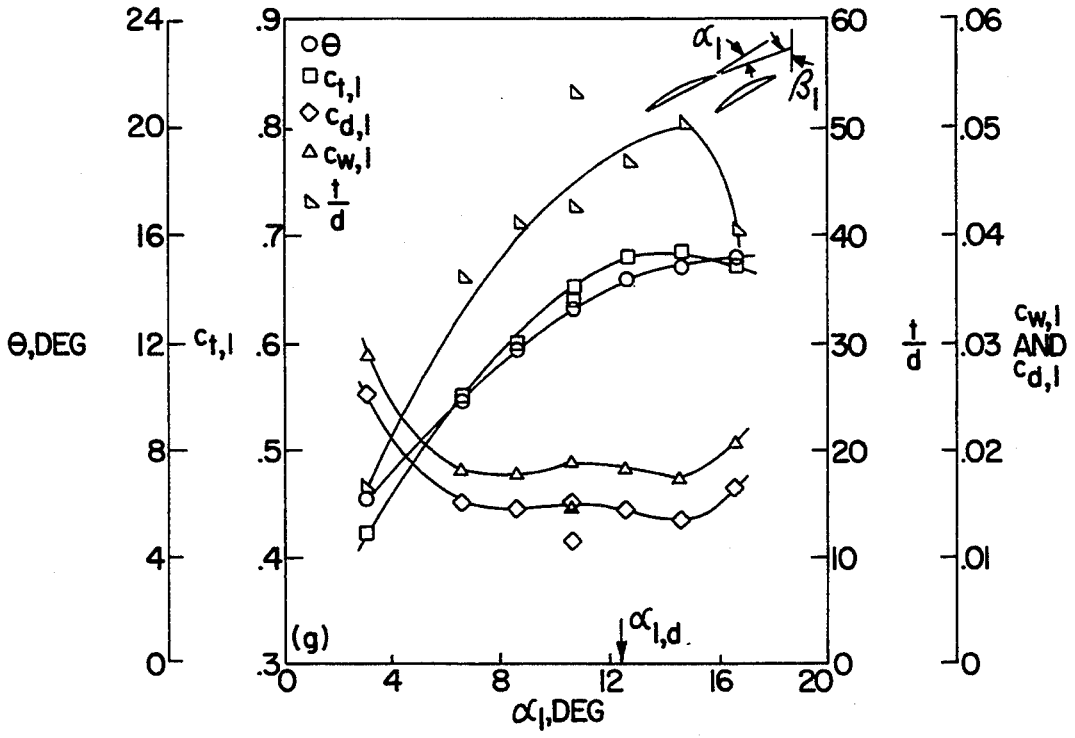
FIG. 4d PRIOR ART
FIG. 4*d* is a prior an diagram illustrating the blade section characteristics for the cascade combination $\beta_1=70°$, $\sigma=1.00$ and blade section NACA 65-(12)10.
Figures 1, 5A:
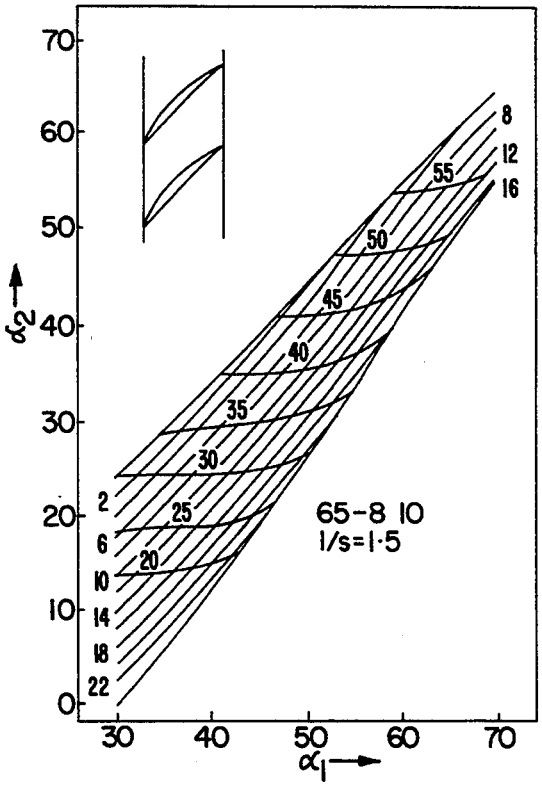
FIG. 5a-1 PRIOR ART
FIGS. 5*a* and 5*b* are prior art diagrams illustrating a series of "Mellor plots" of turning information for a wide variety of NACA tests in the format depicted in FIG. 2.
Figures 2, 5A:
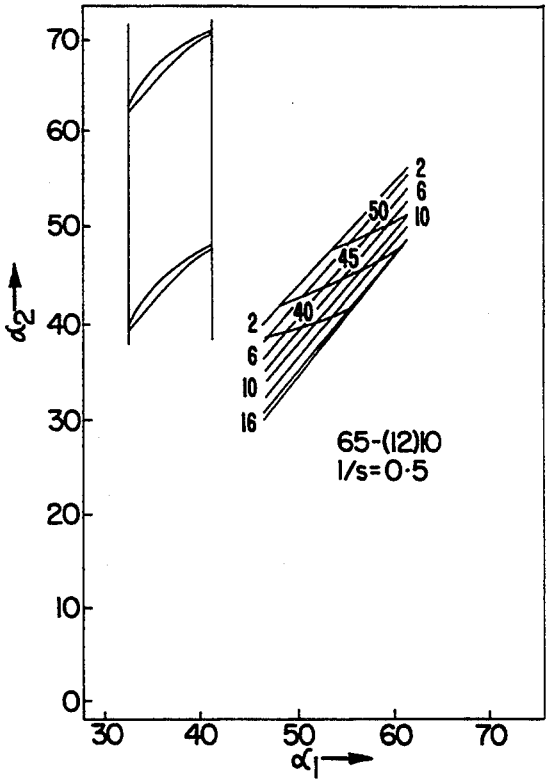
FIG. 5a-2 PRIOR ART
Figures 3, 5A:
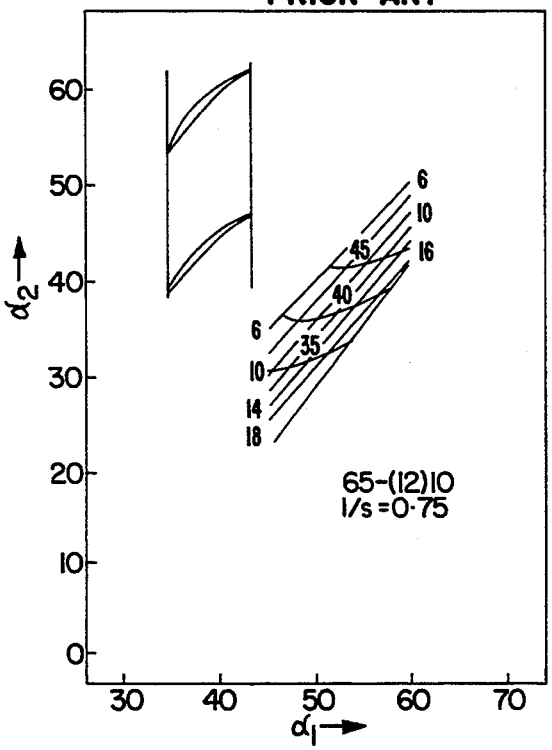
FIG. 5a-3 PRIOR ART
Figures 4, 5A:
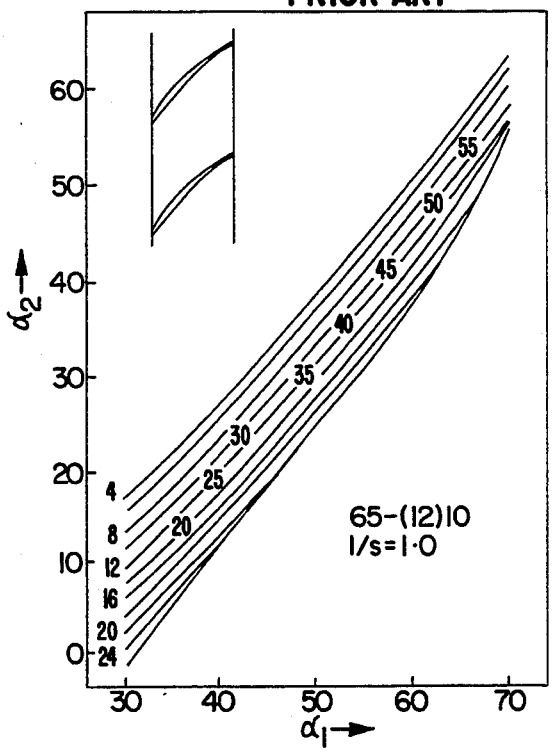
FIG. 5a-4 PRIOR ART
Figures 1, 5B:
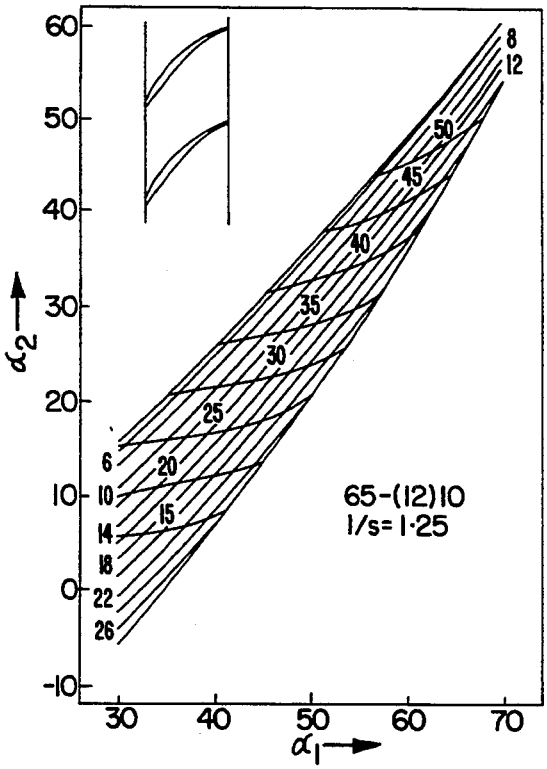
FIG. 5b-1 PRIOR ART
Figures 2, 5B:
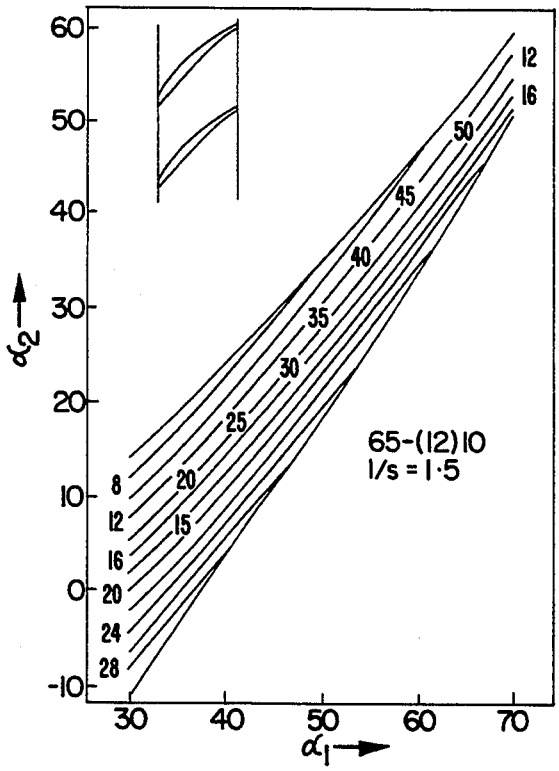
FIG. 5b-2 PRIOR ART
Figures 3, 5B:
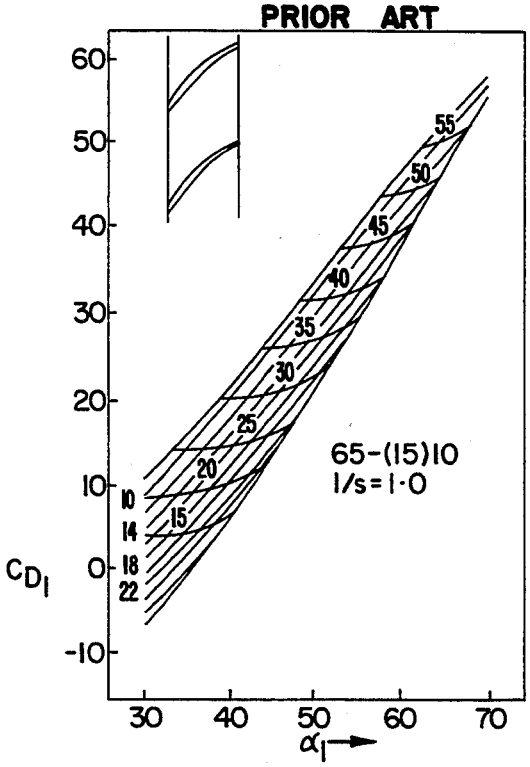
FIG. 5b-3 PRIOR ART
Figures 4, 5B:
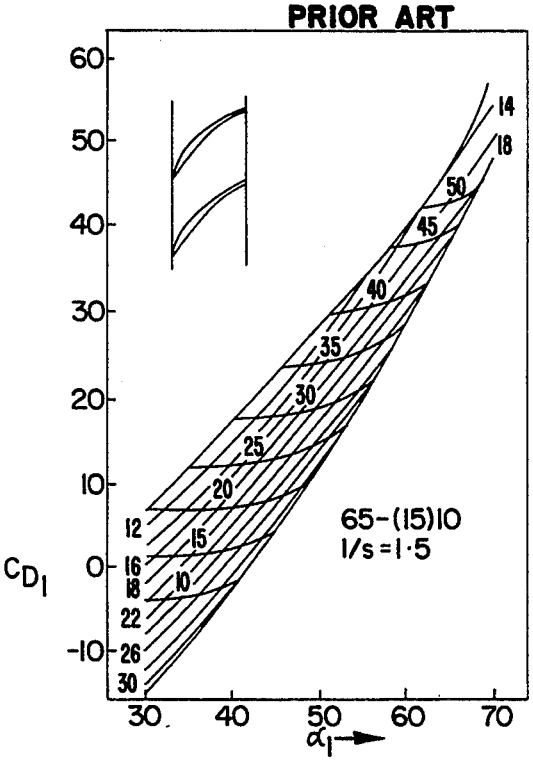
FIG. 5b-4 PRIOR ART
Figure 6:
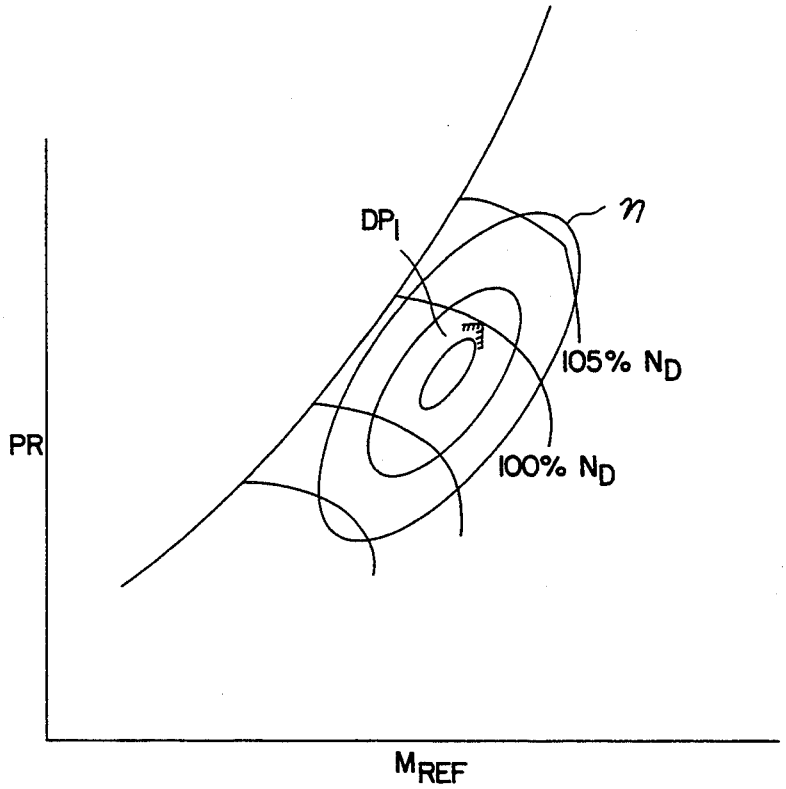
FIG. 6 PRIOR ART
FIG. 6 is a prior art diagram of a typical compressor map.
Figure 8:
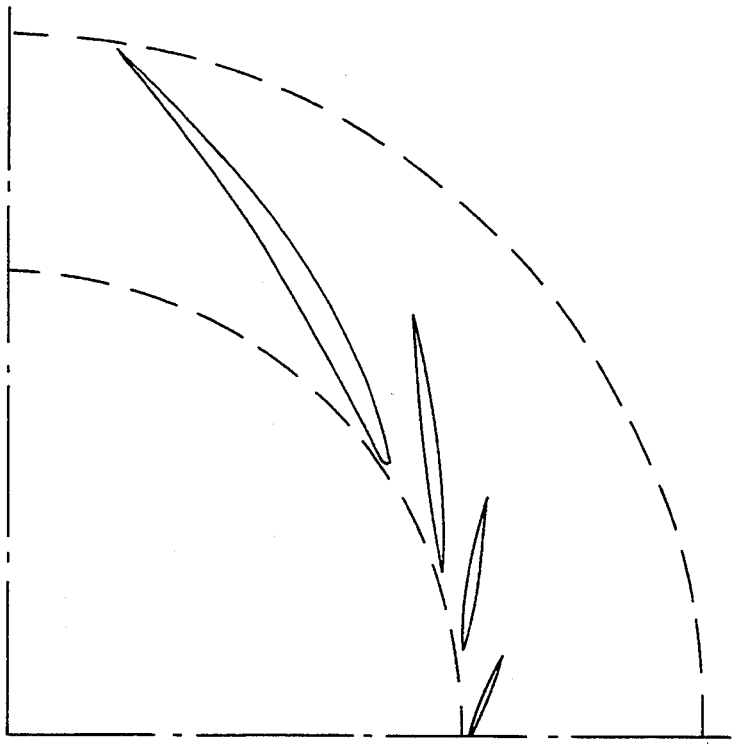
FIG. 8 is a diagram illustrating the transformation of an airfoil from the Cartesian to cylindrical system with an anomaly that depending upon the length of the airfoil, there can be an apparent reversal in curvature of the airfoil; and, FIG. 9 is a diagrammatic view depicting an impeller and a diffuser with a plurality of airfoil vanes.

It is important to consider the transformation from Cartesian or rectilinear coordinates to the cylindrical coordinate system. For FIGS. 3*a* and 3*b*, a standard diagram for an axial cascade is used. The blade coordinates are defined in an XY, or Cartesian or so-called rectilinear coordinate system. For centrifugal compressor design, following the classical approaches used up to the present time, blade geometry and aerodynamic information is carried from the Cartesian to the cylindrical system by a mathematical transformation. For example, any one of the airfoils shown in FIG. 5 can be transformed from the Cartesian to the cylindrical system shown in FIG. 8 which illustrates a frequently occuring anomaly. Depending on the length of the airfoil selected, one can have an apparent reversal in the curvature of the illustrated airfoil. For the largest exit radius, there is a smooth curvature to the airfoil. However, as the airfoil exit radius moves inwardly, the curvature seems to reverse and the trailing edge kicks out in the opposite (apparent) direction. All of these are correct mathematical transformations for equivalent cascades. All of them are, at least in principle, following classical theory, legitimate options for comparable cascade sets. The difference is in the number of vanes which must be larger when shorter ones are utilized in order to maintain the same vane solidity. Due to this fact, and other reasons presented below, the identification of suction and pressure sides on an airfoil when used in the cylindrical system as required for a centrifugal compressor can be confusing. The other source of confusion is the variation of airfoil shape with respect to the streamline shape in the cylindrical system.

For an airfoil which appears to have a simple are of curvature, the suction surface is the lower surface and the pressure surface is the upper one. This can be looked at from different view points giving the same answer. If one compares the streamline shape with the airfoils present versus the streamline shape without the airfoils, it becomes clear that the flow of air is being lifted up (that is, the flow of air is being pressed up by the pressure side or sucked up by the suction side) towards a more radial orientation. Also, if one examines the rise in pressure through the system, it becomes clear, under most operating conditions, that the pressures are increasing along the suction side and then subsequently further along the pressure side. Hence, the pressure levels must be higher on the so-called pressure side than they are on the m-called suction side. Since this is a natural fact of the flow conditions, the suction side must face the radial center. However, from the standpoint of curvature, this appears to be (and is) opposite to what one experiences for an axial compressor. Consequently, people frequently mislabel the sides with respect to suction or pressure for airfoils in a centrifugal compressor system and there is much confusion.

Figure 9:
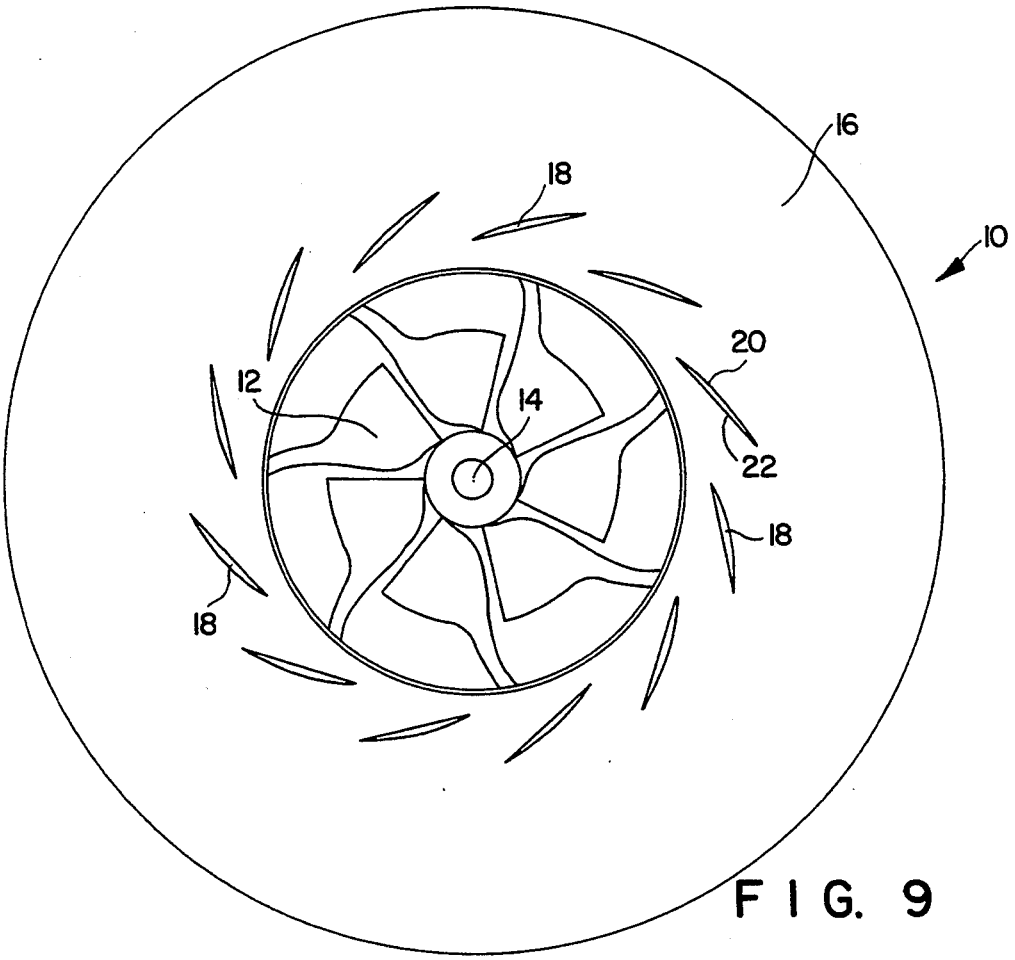

The correct configuration is illustrated in the diagrammatic view of FIG. 9 which depicts a radial turbo machine, indicated generally by the reference number 10. The radial turbo machine 10 has an impeller 12 that rotates about a rotational axis 14. A diffuser 16 has a plurality of airfoil vanes 18 that have a design point angle of attack ("AOA") corresponding to the classic onset of pressure side stall of the airfoil. The airfoil pressure side 20 faces away from the rotational axis 14 of the impeller while the suction side 22 faces towards the impeller's rotational axis.

It will be appreciated that while the preceding discussion has referred to the NACA 65-series of blade sections, corresponding airfoil shapes can be classified in other systems with other nomenclature. Accordingly, the term "corresponding substantially to NACA 65-series blade section" is used herein to cover such systems as well as the NACA 65 series itself.

Having described in detail a preferred embodiment of our invention, it will now be apparent to those skilled in the art that numerous modifications can be made therein without departing from the scope of the invention as defined in the following claims.

What we claim is:

1. A radial turbo machine comprising:

an impeller means having a rotational axis;

a diffuser means having a plurality of airfoil vanes, said airfoil vanes each having a pressure side facing away from and a suction side facing towards the rotational axis of said impeller means with at least some of said airfoil vanes having a design point angle of attack substantially equal to or less than an angle of attack corresponding to the classic onset of pressure side stall of the airfoil vane.

2. The radial turbo machine of claim 1 wherein at least some of said airfoil vanes are cambered.

3. The radial turbo machine of claim 1 wherein all of said airfoil vanes are cambered.

4. The radial turbo machine of claim 1 wherein at least some of said airfoil vanes are uncambered.

5. The radial turbo machine of claim 1 wherein all of said airfoil vanes are uncambered.

6. The radial turbo machine of claim 1 wherein said airfoil vanes have an airfoil shape corresponding substantially to NACA 65-series blade sections with a lift coefficient from 0.0 to 1.2 inclusive and a thickness from 4% to 15% inclusive.

7. The radial turbo machine of claim 6 wherein said airfoil vanes have a NACA 65-04-06 blade section and said design point angle of attack is substantially equal to or less than +3.5°.

8. The radial turbo machine of claim 7 wherein the design point angle of attack is in the range from −3.5° to +3.5° inclusive.

9. The radial turbo machine of claim 7 wherein the design point angle of attack is substantially at 0°.

10. The radial turbo machine of claim 1 wherein all of said airfoil vanes have a design point angle of attack equal to or less than ab angle of attack corresponding to the classic onset of pressure side stall of the airfoil vane.

11. The radial turbo machine of claim 10 wherein at least some of said airfoil vanes are cambered.

12. The radial turbo machine of claim 11 wherein all of said airfoil vanes are cambered.

13. The radial turbo machine of claim 10 wherein at least some of said airfoil vanes are uncambered.

14. The radial turbo machine of claim 13 wherein all of said airfoil vanes are uncambered.

15. The radial turbo machine of claim 10 wherein said airfoil vanes have an airfoil shape corresponding substantially to NACA 65-series blade sections with a lift coefficient from 0.0 to 1.2 inclusive and a thickness from 4% to 15% inclusive.

16. The radial turbo machine of claim 15 wherein said airfoil vanes have a NACA 65-04-06 blade section and said design point angle of attack is substantially equal to or less than +3.5°.

17. The radial turbo machine of claim 16 wherein the design point angle of attack is in the range from −3.5° to +3.5° inclusive.

18. The radial turbo machine of claim 16 wherein the design point angle of attack is substantially at 0°.

* * * * *